US008201690B1

(12) United States Patent
Gess

(10) Patent No.: US 8,201,690 B1
(45) Date of Patent: Jun. 19, 2012

(54) END USER FILLED PROTECTIVE PACKAGING WITH SELF-SEALING AIR BUBBLES

(76) Inventor: Larry C. Gess, Palmyra, WI (US)

( * ) Notice: Subject to any disclaimer, the term of this patent is extended or adjusted under 35 U.S.C. 154(b) by 0 days.

(21) Appl. No.: 13/118,776

(22) Filed: May 31, 2011

Related U.S. Application Data

(60) Provisional application No. 61/351,591, filed on Jun. 4, 2010.

(51) Int. Cl.
*B65D 81/03* (2006.01)

(52) U.S. Cl. ..... 206/522; 141/35; 141/114

(58) Field of Classification Search ..... 206/522, 206/521; 383/3; 137/883, 855, 512.4; 141/10, 141/35, 67, 68, 114
See application file for complete search history.

(56) References Cited

U.S. PATENT DOCUMENTS

| | | | | |
|---|---|---|---|---|
| 4,551,379 | A * | 11/1985 | Kerr | 428/200 |
| 4,983,138 | A | 1/1991 | McGrath | |
| 5,427,830 | A * | 6/1995 | Pharo | 428/35.2 |
| 5,727,270 | A * | 3/1998 | Cope et al. | 5/710 |
| 6,722,502 | B1 * | 4/2004 | Newman | 206/586 |
| 7,694,701 | B2 | 4/2010 | Koyanagi | |
| 2003/0096068 | A1 * | 5/2003 | Peper | 428/34.1 |
| 2010/0072103 | A1 * | 3/2010 | Watanabe et al. | 206/522 |

* cited by examiner

*Primary Examiner* — Jacob K Ackun
*Assistant Examiner* — Jenine Pagan
(74) *Attorney, Agent, or Firm* — Donald J. Ersler

(57) ABSTRACT

End user filled protective packaging with self-sealing air bubbles includes a bubble layer, a valve layer and a valve cover layer. A plurality of bubble cell patterns are formed on the bubble layer with adhesive, glue or heat sealing. The valve layer is attached to bubble layer. A plurality of check valves are formed on the valve layer with adhesive, glue or heat sealing. An air opening is formed through each one of the plurality of check valves to inflate the plurality of bubble cells. The valve cover layer is attached to the valve layer. A row with at least one bubble cell is filled with air by applying a source of air at an entrance of the check valve. Inflation of the at least one bubble cell causes the valve layer and valve cover layer to contact each other to seal the check valve.

19 Claims, 4 Drawing Sheets

END USER FILLED PROTECTIVE PACKAGING WITH SELF-SEALING AIR BUBBLES

CROSS-REFERENCES TO RELATED APPLICATIONS

This is a nonprovisional patent application taking priority from provisional application No. 61/351,591 filed on Jun. 4, 2010.

BACKGROUND OF THE INVENTION

1. Field of the Invention

The present invention relates generally to inflatable packaging and more specifically to an end user filled protective packaging with self-sealing air bubbles, which does not require complex machinery to fill the inflatable bag.

2. Discussion of the Prior Art

It is well known in the art of inflatable packaging to fill multiple compartments with air and then seal the multiple compartments to retain the air therein. However, the inflatable packaging is typically complicated or the machinery used to produce the inflatable packaging with air is also complicated. A complicated inflatable dunnage bag will require complicated machinery to fill thereof. A complicated inflatable packaging machine will not always produce a consistent product, due to the complexity of the machine and also variations in the sheet material used to produce the inflatable packaging.

Typically, a manufacturer of inflatable packaging provides a customer with inflatable packaging machines at no cost and sells the inflatable packaging to the customer. Any problems with the inflatable packaging machines is the manufacturer's responsibility and expense. It is to the manufacturer's advantage to have the simplest and most inexpensive inflatable packaging machines to produce the inflatable packaging. Having inexpensive inflatable packaging machinery makes it possible to sell the inflatable packaging to smaller companies.

U.S. Pat. No. 4,983,183 to McGarth discloses an inflatable container with self-sealing valve. The McGarth patent discloses a one layer self-sealing, self-regulating, two-way flat valve for fluid containers, such as toy balloons and the like formed of two heat sealed film layers, is provided. U.S. Pat. No. 7,694,701 to Koyanagi discloses a structure or check valve for air-packing device. A check valve for an air-packing device comprises upper and lower check valve films that are placed between upper and lower packing films that form the air packing device contour. The check valve can be advantageously used for the air-packing device having a multiplicity of air containers.

Accordingly, there is a clearly felt need in the art for an end user filled protective packaging with self-sealing air bubbles, which provides a non-complex inflatable package that may be filled with an air hose instead complicated machinery.

SUMMARY OF THE INVENTION

The present invention provides an end user filled protective packaging with self-sealing air bubbles, which does not require complex machinery to fill the inflatable bag. The end user filled protective packaging with self-sealing air bubbles (inflatable bubble packaging) includes a bubble layer, a valve layer and a valve cover layer. If a substance is used to form a plurality of bubble cells, a bubble cell pattern is printed on a top of the bubble layer. Otherwise, at least one heat sealing roller has the plurality of bubble cells formed thereupon. If a substance is used to form a plurality of check valves, a check valve pattern is printed on a top of the valve layer. Otherwise, at least one heat sealing roller has the plurality of check valves formed thereupon. An air opening is formed through each one of the plurality of check valves, adjacent to an end of the check valve to provide passage of air from the check valve to at least one bubble cell in a row.

The valve layer is either adhesively attached or heat sealed to the bubble layer to form the plurality of bubble cells. The valve cover layer is adhesively attached or heat sealed to the valve layer to form the plurality of check valves. A row with at least one bubble cell is filled with air by applying a source of air at an entrance of the check valve. The air travels through the air opening into the at least one bubble cell. Inflation of the at least one bubble cell causes the valve layer and valve cover layer to contact each other to seal the check valve to prevent air from escaping the at least one bubble cell. A clinging substance is preferably applied to an inside surface of at least one of the valve layer and the valve cover layer in the check valve. The clinging substance causes the valve layer to cling to the valve cover layer and thus prevent air from escaping the at least one bubble cell through the check valve.

Accordingly, it is an object of the present invention to provide a non-complex inflatable package that may be filled with an air hose instead of complicated machinery.

These and additional objects, advantages, features and benefits of the present invention will become apparent from the following specification.

DETAILED DESCRIPTION OF THE PREFERRED EMBODIMENTS

Figure 1:
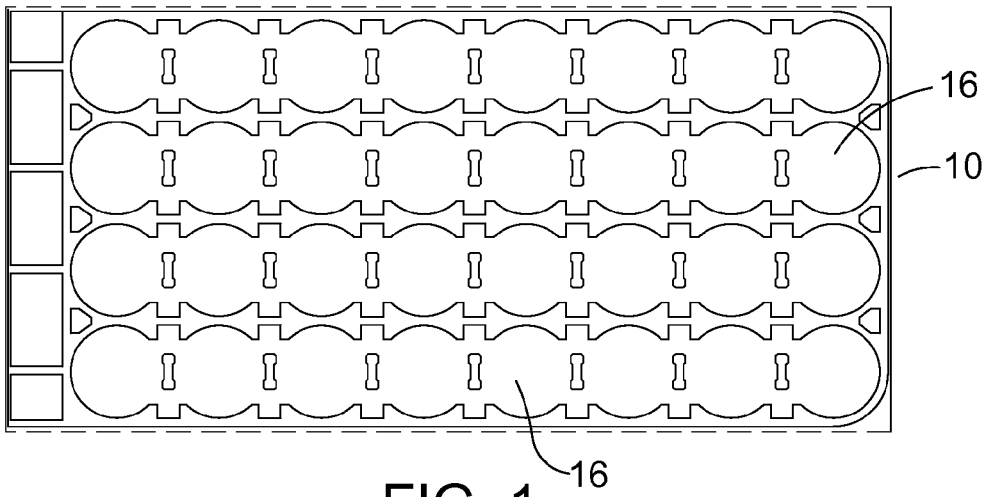
FIG. 1 is a top view of a bubble layer of inflatable bubble packaging in accordance with the present invention.
Figure 2:
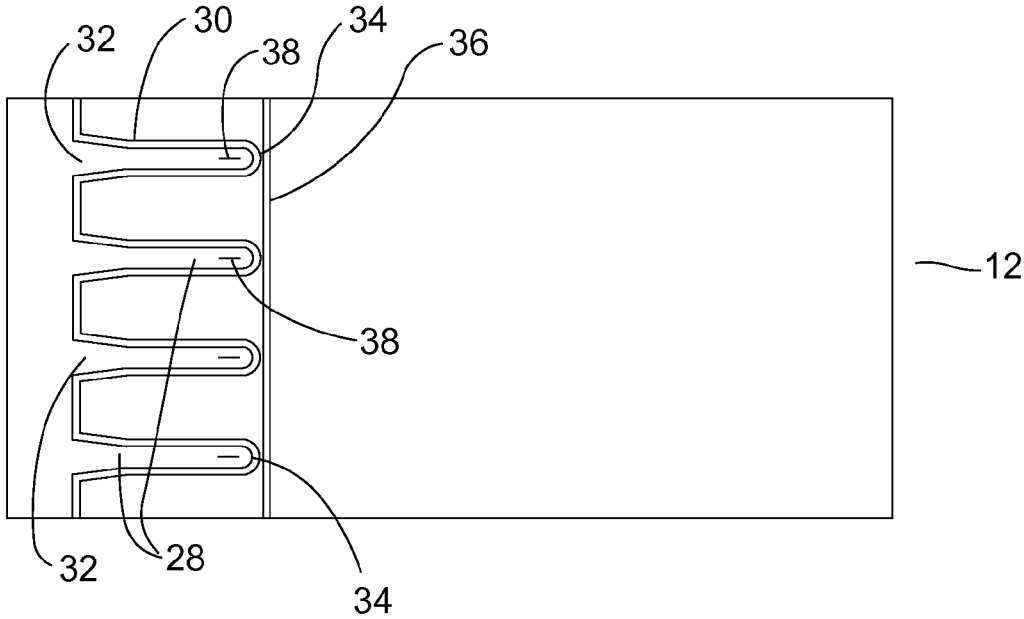
FIG. 2 is a top view of a valve layer of inflatable bubble packaging in accordance with the present invention.
Figure 3:
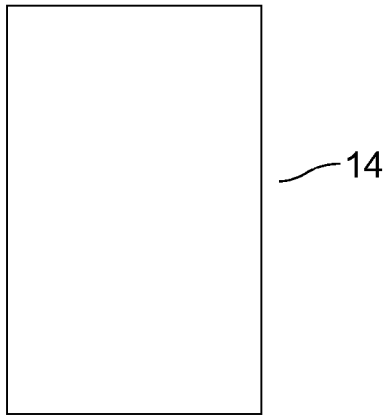
FIG. 3 is a top view of a valve cover layer of inflatable bubble packaging in accordance with the present invention.
Figure 4:
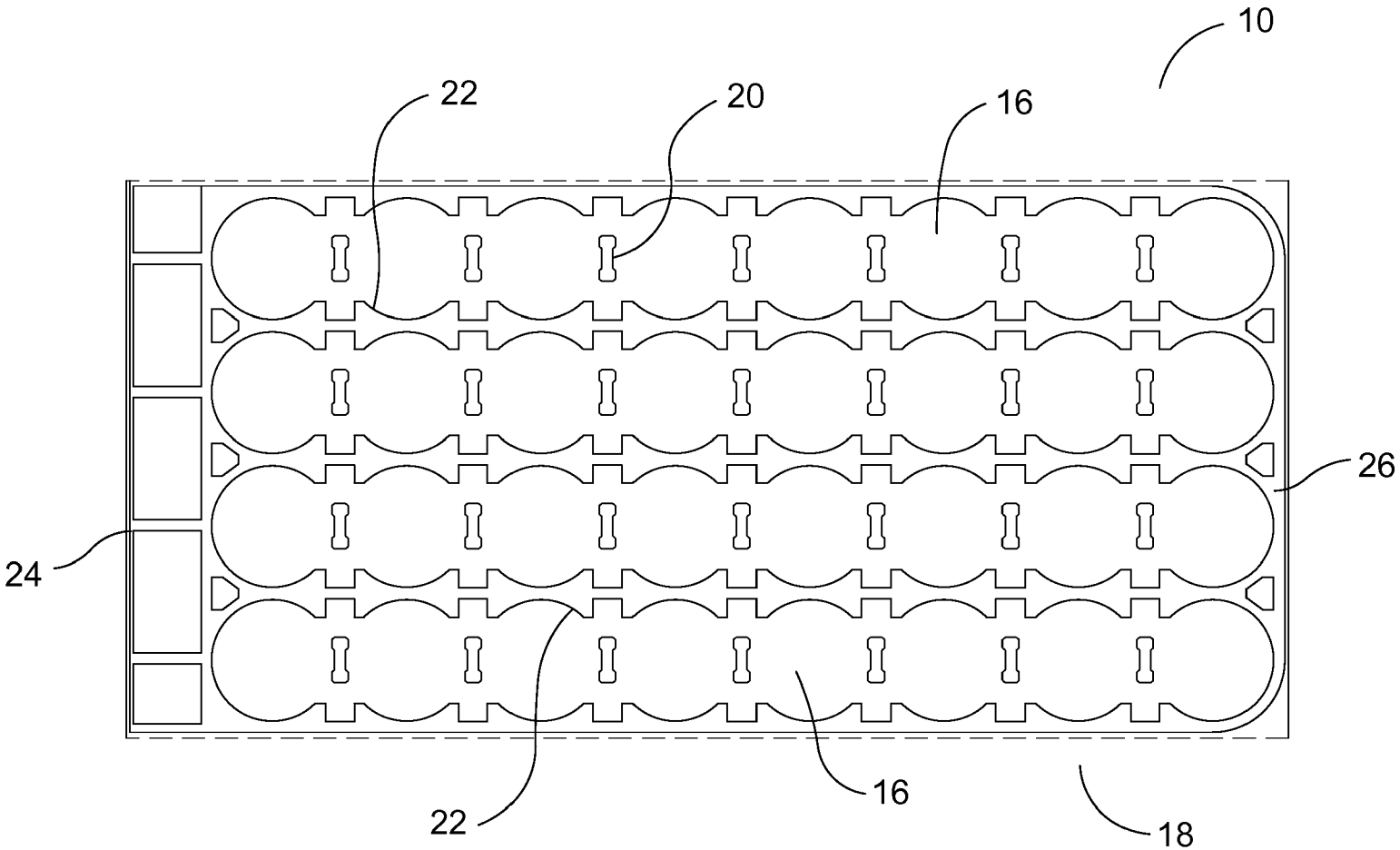
FIG. 4 is a top view of an enlarged bubble layer of inflatable bubble packaging in accordance with the present invention.
Figure 5:
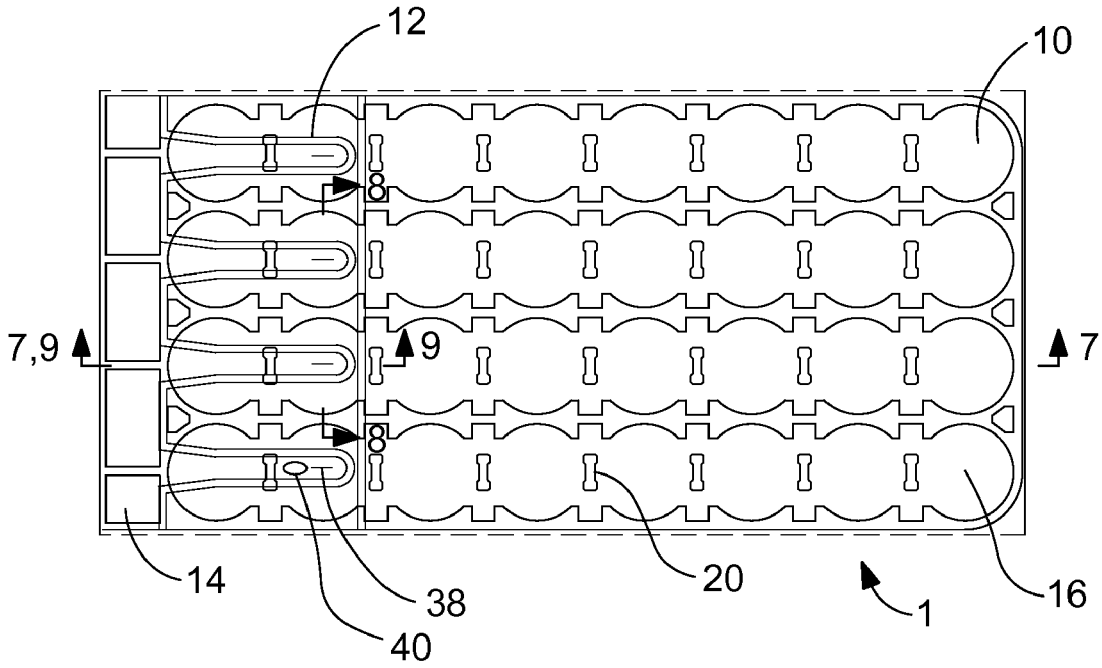
FIG. 5 is a top view of an assembled inflatable bubble package in accordance with the present invention.
Figure 6:
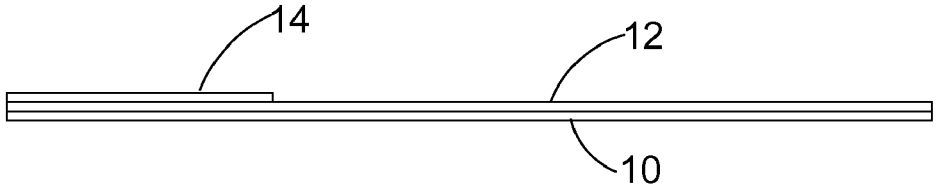
FIG. 6 is a end view of an assembled inflatable bubble package in accordance with the present invention.

With reference now to the drawings, and particularly to FIG. 5, there is shown a top view of assembled inflatable bubble packaging 1. With reference to FIGS. 1-4 and 6, the inflatable bubble packaging 1 includes a bubble layer 10, a valve layer 12 and a valve cover layer 14. If a substance is used to form a plurality of bubble cells 16 on the bubble layer 10, a bubble cell pattern 18 is printed an inside surface of the bubble layer 10. The bubble cell pattern 18 includes a plurality of bubble end perimeter portions 20, a plurality of bubble side perimeters 22, an input end portion 24 and an output end portion 26. The substance is preferably an ultraviolet cured adhesive, but other substances, such as adhesive or an ultraviolet cured glue may also be used. The valve layer 12 is secured to the bubble layer 10 with the bubble cell pattern 18. Otherwise, at least one bubble heat sealing roller has a raised heat sealing surface that has the same pattern shape as the bubble cell pattern 18 to heat seal the valve layer 12 to the bubble layer 10.

If a substance is used to form a plurality of check valves 28 on the valve layer 12, then a check valve pattern 30 having a continuous line is printed on a top surface of the valve layer 12. The check valve pattern 30 includes a plurality of input entrances 32 on one end and a plurality of closed areas 34 on the other end. A sealing line 36 is formed adjacent the plurality of closed areas 34. An air opening 38 is formed through the valve layer 12, adjacent the closed area 34 to allow air to pass through the check valve 28 into the at least one bubble cell 16. The air opening 38 is preferably a slit, but could be any other type of opening. The valve cover layer 14 is secured to the valve layer 12 with the check valve pattern 30 and the sealing line 36. Otherwise, at least one heat sealing roller has a raised heat sealing surface that has the same pattern shape as the check valve pattern 30 and the sealing line 36 to heat seal the valve cover layer 14 to the valve layer 12.

Figure 7:
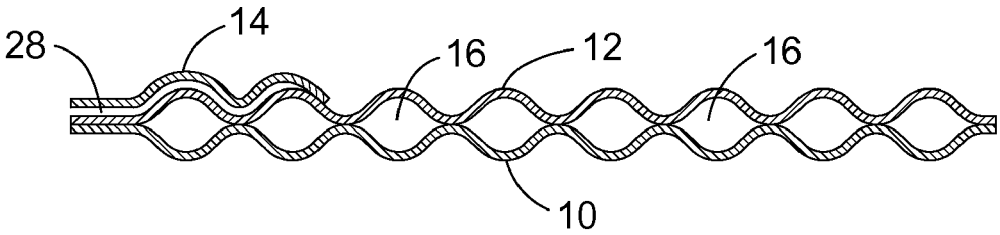
FIG. 7 is a cross sectional view of an inflatable bubble package during filling with pressurized air in accordance with the present invention.
Figure 8:
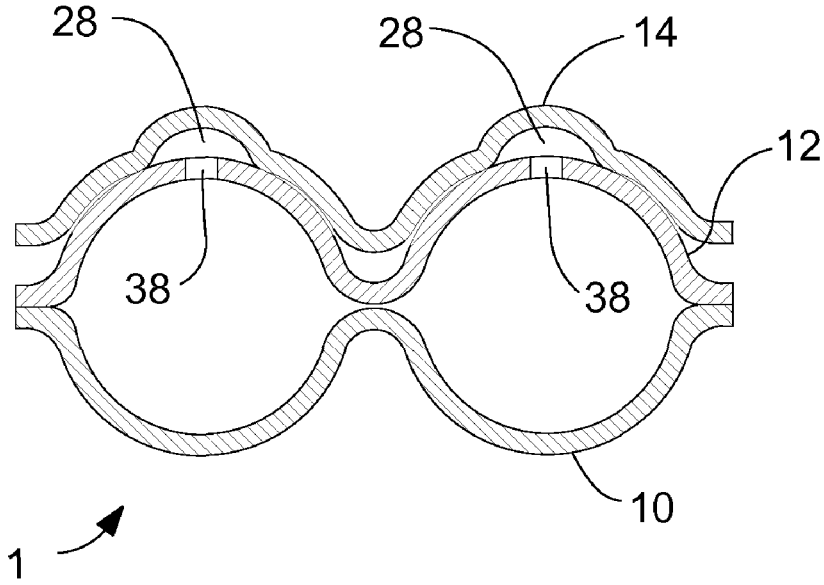
FIG. 8 is a cross sectional view of a portion of an inflatable bubble package cut lengthwise, during filling with pressurized air in accordance with the present invention.

With reference to FIG. 7, each row of bubble cells 16 are filled with air by applying a source of pressurized air at the input entrance 32 of a particular row of bubble cells 16. Air pressure inflates each bubble cell 16. Air flows past each end of a plurality of bubble end perimeter portions 20, until air fills a last bubble cell 16. Successive bubble cells 16 are filled with air, until all bubble cells 16 are filled with air. With reference to FIG. 8, air travels through the check valve 28 through the air opening 38 into the second bubble cell 16 in the row of bubble cells 16.

Figure 9:
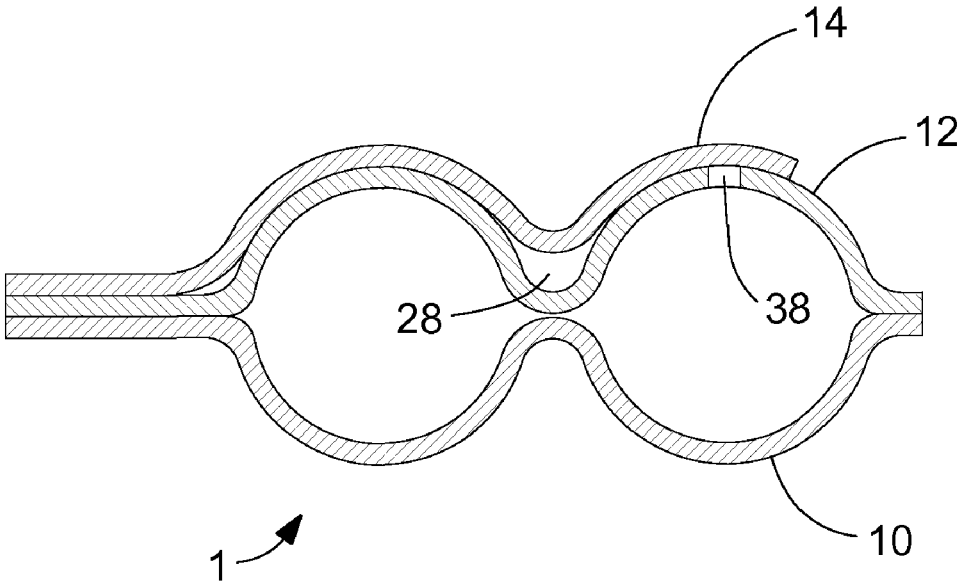
FIG. 9 is a cross sectional view of a portion of an inflatable bubble package cut through a width, after being filled with air in accordance with the present invention.

As the bubble cells 16 inflate, upward pressure is exerted by the valve layer 12 against the valve cover layer 14. With reference to FIG. 9, when the flow of pressurized air ceases, the valve cover layer 14 contacts the valve layer 12 and seals the check valve 28, such that air cannot flow back out-of the check valve 28. The bubble layer 10, valve layer 12 and the valve cover layer 14 are fabricated from plastic sheet material that must be stretchable to allow a plurality of inflated bubble cells 16 to be formed.

It is preferable to have the air opening 38 located over the second bubble cell 16 to provide more sealing area for the check valve 28. Further, increased sealing integrity could achieved by locating the air opening 38 over a last bubble cell 16. However, the air opening 38 could also be located over the first bubble cell 16. The row of bubble cells 16 could include only a single bubble cell 16 or as many bubble cells 16 as can be practically inflated. The number of rows of bubble cells 16 that may be formed is limited only by the length of plastic sheet.

With reference to FIG. 5, a clinging substance 40 is preferably located in the check valve 28. The clinging substance 40 is applied to an inside surface of at least one of the valve layer 12 and the valve cover layer 14. The clinging substance 40 may also be applied around the air opening 38. The clinging substance 40 causes the valve layer 12 to cling to the valve cover layer 14 and thus provide additional protection from air escaping the at least one bubble cell 16 through the check valve 28. The clinging substance 40 may be any appropriate substance that can be cured or allowed to dry to produce a tacky surface, such as ultraviolet curing adhesive.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An end user filled protective packaging with self-sealing air bubbles, comprising:

a bubble layer;

a valve layer is attached to said bubble layer to form a plurality of bubble cell patterns, each one of said plurality of bubble cell patterns includes a plurality of bubble cells;

a valve cover layer is attached to said valve layer to form a plurality of check valves, an air opening is formed through each one of said plurality of check valves to communicate with a second one or greater of said plurality of bubble cells, a length of one of said plurality of check valves is greater than a length of one of said plurality of bubble cells, wherein said plurality of bubble cells in one of said plurality of bubble cell patterns are filled with air through one of said plurality of check valves, air is prevented from escaping through said air opening when said check valve is closed by said valve layer contacting said valve cover layer.

2. The end user filled protective packaging with self-sealing air bubbles of claim 1 wherein:

said bubble cell pattern includes a plurality of bubble end perimeter portions, a plurality of bubble side perimeters, an input end portion and an output end portion.

3. The end user filled protective packaging with self-sealing air bubbles of claim 1 wherein:

said bubble cell pattern is created by printing one of an adhesive, an ultraviolet cured adhesive and an ultraviolet cured glue.

4. The end user filled protective packaging with self-sealing air bubbles of claim 1 wherein:

said bubble cell pattern is created on at least one heat sealing roller.

5. The end user filled protective packaging with self-sealing air bubbles of claim 1 wherein:

a check valve pattern is formed on said valve layer, said check valve pattern includes said plurality of check valves.

6. The end user filled protective packaging with self-sealing air bubbles of claim 5 wherein:

said check valve pattern is created by printing one of an adhesive, an ultraviolet cured adhesive and an ultraviolet cured glue.

7. The end user filled protective packaging with self-sealing air bubbles of claim 5 wherein:

said check valve pattern is created on at least one heat sealing roller.

8. The end user filled protective packaging with self-sealing air bubbles of claim 1 wherein:

a clinging substance is located in each one of said plurality of check valves.

9. An end user filled protective packaging with self-sealing air bubbles, comprising:

a bubble layer;

a valve layer is attached to said bubble layer to form a bubble cell pattern, each one of said plurality of bubble cell patterns includes a plurality of bubble cells arranged in a row;

a valve cover layer is attached to said valve layer to form a plurality of check valves, an air opening is formed through each one of said plurality of check valves to communicate with a second one or greater of said plurality of bubble cells, a length of one of said plurality of check valves is greater than a length of one of said plurality of bubble cells, wherein said plurality of bubble cells in one of said plurality of bubble cell patterns are filled with air through one of said plurality of check valves, air is prevented from escaping through said air opening when said check valve is closed by said valve layer contacting said valve cover layer.

10. The end user filled protective packaging with self-sealing air bubbles of claim 9 wherein:

said bubble cell pattern includes a plurality of bubble end perimeter portions, a plurality of bubble side perimeters, an input end portion and an output end portion.

11. The end user filled protective packaging with self-sealing air bubbles of claim 10 wherein:

said bubble cell pattern is created by printing one of an adhesive, an ultraviolet cured adhesive and an ultraviolet cured glue.

12. The end user filled protective packaging with self-sealing air bubbles of claim 10 wherein:

said bubble cell pattern is created on at least one heat sealing roller.

13. The end user filled protective packaging with self-sealing air bubbles of claim 9 wherein:

a check valve pattern is formed on said valve layer, said check valve pattern includes said plurality of check valves.

14. The end user filled protective packaging with self-sealing air bubbles of claim 13 wherein:

said check valve pattern is created by printing one of an adhesive, an ultraviolet cured adhesive and an ultraviolet cured glue.

15. The end user filled protective packaging with self-sealing air bubbles of claim 13 wherein:

said check valve pattern is created on at least one heat sealing roller.

16. The end user filled protective packaging with self-sealing air bubbles of claim 9 wherein:

a clinging substance is located in each one of said plurality of check valves.

17. An end user filled protective packaging with self-sealing air bubbles, comprising:

a bubble layer;

a valve layer is attached to said bubble layer to form a bubble cell pattern, each one of said plurality of bubble cell patterns includes a plurality of bubble cells;

a valve cover layer is attached to said valve layer to form a check valve pattern, said check valve pattern includes a plurality of check valves, an air opening is formed through each one of said plurality of check valves to communicate with a second one or greater of said plurality of bubble cells, a length of one of said plurality of check valves is greater than a length of one of said plurality of bubble cells, wherein said plurality of bubble cells in one of said plurality of bubble cell patterns are filled with air through one of said plurality of check valves, air is prevented from escaping through said air opening when said check valve is closed by said valve layer contacting said valve cover layer.

18. The end user filled protective packaging with self-sealing air bubbles of claim 17 wherein:

said bubble cell pattern includes a plurality of bubble end perimeter portions, a plurality of bubble side perimeters, an input end portion and an output end portion.

19. The end user filled protective packaging with self-sealing air bubbles of claim 17 wherein:

said check valve pattern is created by printing one of an adhesive, an ultraviolet cured adhesive and an ultraviolet cured glue.

* * * * *